United States Patent [19]

Woodall

[11] Patent Number: 4,838,549

[45] Date of Patent: Jun. 13, 1989

[54] BASKETBALL RETRIEVER DEVICE

[76] Inventor: Bliss T. Woodall, 625 Rebel Rd., Old HIckory, Tenn. 37138

[21] Appl. No.: 192,913

[22] Filed: May 12, 1988

[51] Int. Cl.[4] ..... A63B 69/00

[52] U.S. Cl. ..... 273/1.5 A

[58] Field of Search ..... 273/1.5 R, 1.5 A, 397; D21/201

[56] References Cited

U.S. PATENT DOCUMENTS

| | | | |
|---|---|---|---|
| D. 284,599 | 7/1986 | Cochran | D21/201 |
| 1,574,201 | 2/1926 | Lynch | 273/397 |
| 1,924,757 | 8/1933 | Shisoff | 273/397 |
| 3,917,263 | 11/1975 | Wiley | 273/1.5 A |
| 4,667,957 | 5/1987 | Joseph | 273/1.5 A |
| 4,697,810 | 10/1987 | Mathison | 273/1.5 A |

*Primary Examiner*—Paul E. Shapiro

*Attorney, Agent, or Firm*—Harrington A. Lackey

[57] ABSTRACT

A basketball retriever device including an elongated chute having a bottom panel, upright side panels, and an open rear end, and adapted to fit around a basketball basket to guide a basketball shot to the vicinity of the basket and to guide the return of the basketball to the front end of the chute. A basketball receiver device includes a cradle beneath the front end of the chute for receiving the returned basketball and an extensible ramp member for guiding the balls from the chute to a variety of shooting positions for a basket player. The retriever device further includes auxiliary closure panels for closing the area adjacent the rear end of the chute when the chute is disposed at angles to the basketball backboard other than a perpendicular position relative to the backboard.

12 Claims, 4 Drawing Sheets

BASKETBALL RETRIEVER DEVICE

BACKGROUND OF THE INVENTION

This invention relates to a basketball retriever device and more particularly to a basketball retriever device capable of being utilized from different shooting positions.

Basketball retriever devices of various types are known in the art, as illustrated in the following U.S. Pat. Nos.:

1,765,259, Hatley, June 17, 1930;
3,776,550, McNabb, Dec. 4, 1973;
3,917,263, Wiley, Nov. 4, 1975;
4,291,885, Cohen, Sept. 29, 1981;
4,579,340, Jenkins et al, Apr. 1, 1986;
4,667,957, Joseph, May 26, 1987.

All of the above patents, except the Wiley patent, disclose large net-covered ball collectors mounted beneath the basketball basket for receiving and discharging basketballs shot toward the basket, whether the basketball passes through the basket or not.

McNabb, Wiley, and Joseph disclose various types of chutes or ramps located beneath a discharge opening in a basketball collector for guiding the ball by gravity toward the shooter. The ramps 92 in FIG. 5 of the Joseph patent incorporate a pair of parallel rails upon which the ball travels by gravity to a position adjacent the shooter.

Other basketball retriever devices are disclosed in the prior art cited in the above cited patents, and specifically the McNabb U.S. Pat. No. 3,776,550, the Cohen U.S. Pat. No. 4,291,885 and the Joseph U.S. Pat. No. 4,667,957.

SUMMARY OF THE INVENTION

It is therefore an object of this invention to provide a basketball retriever device which is not only designed to return the basketball to the shooter or basketball player, but is also designed to assist the shooter in aiming or guiding his shot toward the basket.

It is a further object of this invention to provide a basketball retriever device which is capable of being utilized by the shooter in different shooting positions relative to the basket.

A further object of this invention is to provide a basketball retriever device including an elongated chute having an elongated bottom wall or panel and upright side panels projecting upward from the bottom panel substantially above the basket in its operative position. The chute has a rear opening adapted to fit against the backboard and around the basket and a front discharge opening for returning the ball to the shooter.

A further object of this invention is to provide an elongated chute having upright side and front walls and a bottom discharge opening in the front of the chute and a forwardly declining bottom panel. A receiver device including a cradle is positioned beneath the discharge opening for receiving a basketball from the chute. An extensible ramp member telescopingly received within the cradle is movable longitudinally relative to the cradle for returning the ball to the shooter at different shooting distances from the basket.

It is also within the scope of this invention to provide a basketball retriever device having an elongated chute adapted to be disposed at various angles to the backboard with auxiliary closure panel assemblies for enclosing the exposed areas between the rear end of the chute and the backboard.

DESCRIPTION OF THE PREFERRED EMBODIMENTS

Figures 1, 2:
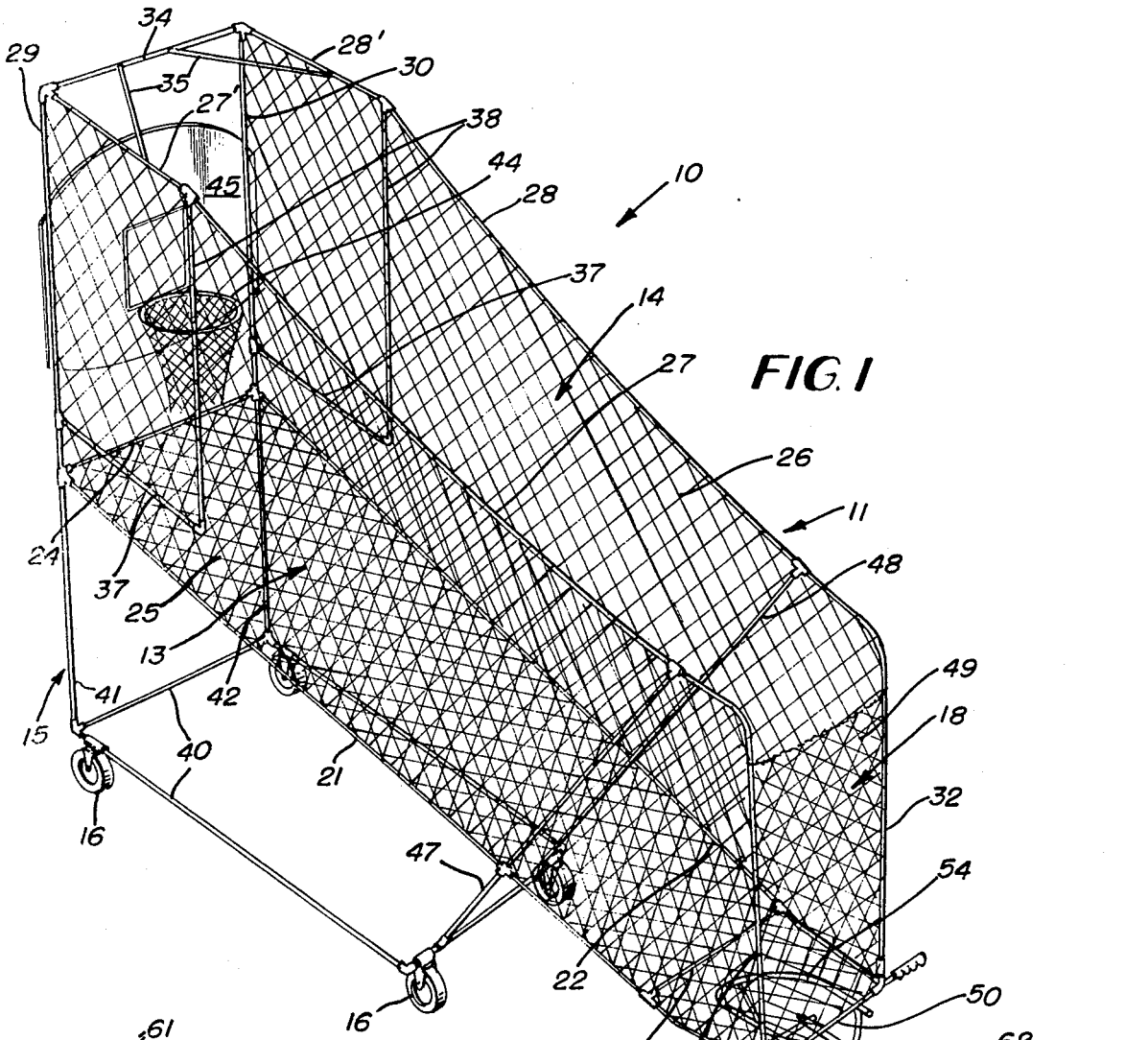
FIG. 1 is a front and side perspective view of the basketball retriever device made in accordance with this invention disposed in an operative position perpendicular to the plane of the backboard and with the ramp member extended.
FIG. 2 is an enlarged fragmentary front and side perspective view of the cradle and ramp member disclosed in FIG. 1, with the ramp member shown in a contracted position in phantom.
Figure 3:
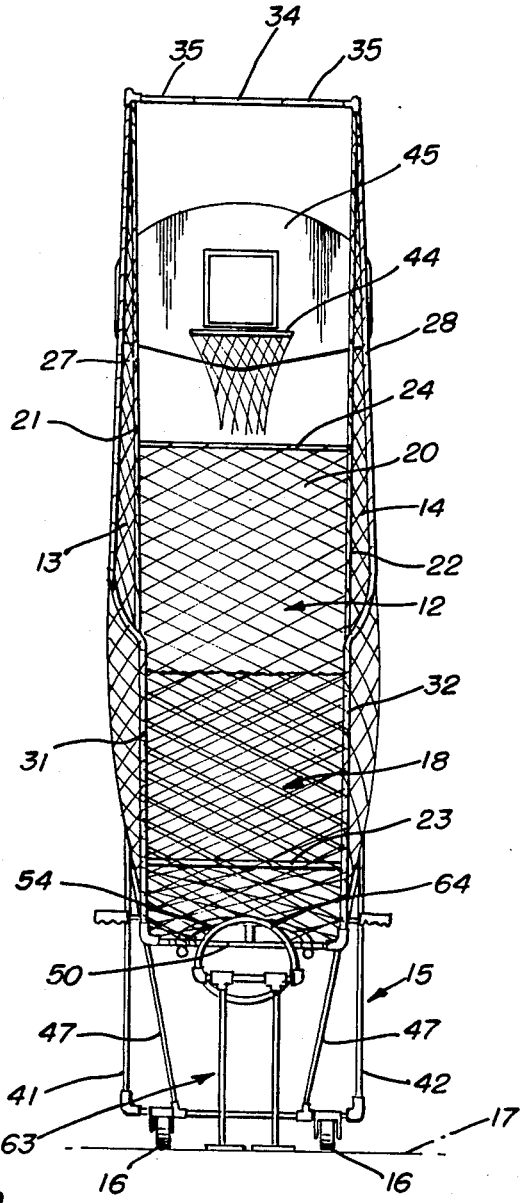
FIG. 3 is a front elevational view of the device disclosed in FIG. 1.
Figure 4:
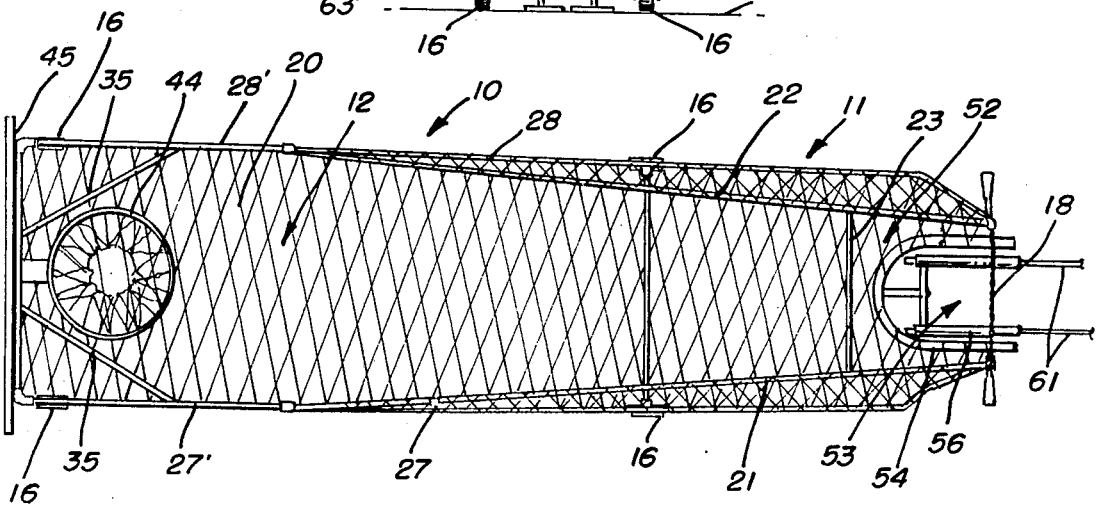
FIG. 4 is a top plan view of the device disclosed in FIG. 1, with portions of the ramp member broken away.

Referring now to the drawings in more detail, FIG. 1 discloses a basketball retriever device 10 made in accordance with this invention including an elongated chute 11 having an elongated substantially rectangular bottom wall or panel 12 (FIG. 4). Projecting upward from the opposite side edges of the bottom panel 12 are a pair of upright side panels 13 and 14, preferably substantially parallel and vertical. The bottom panel 12 is supported upon a mounting frame 15 having floor-engaging wheels 16 to permit the device 10 to be rolled to different positions upon a basketball court floor 17.

In a preferred form of the invention, a front panel 18 spans the front end portions of the side panels 13 and 14.

All of the bottom panel 12, side panels 13 and 14, and front panel 18 are preferably made of netting material connected at their margins to frame bars. The bottom panel 12 includes an elongated strip of netting material 20 suspended between a pair of transversely spaced elongated side bottom frame bars 21 and 22. The front edge portion of the bottom netting 20 is connected to the front transverse bottom bar 23 while its rear edge is connected by stitching, lacing or otherwise to the rear transverse bar 24.

The bottom edges of the side netting 25 of the left side panel 13 are fastened to the elongated side frame bar 21, while the bottom edges of the side netting 26 of the right side panel 14 are secured to the elongated side frame bar 22. The top edges of the netting 25 and 26 are connected to the respective longitudinal top side frame bars 27 and 28. The rear edges of the side netting 25 and 26 are connected to the rear upright bars 29 and 30, while the front edges of the side netting 25 and 26 are connected to the front frame bars 31 and 32. The rear end portions of the top side frame bars 27 and 28 may be provided with horizontal sections 27' and 28', if desired, which are connected to a top rear transverse bar 34. The transverse bar 24 may be reinforced by the angular brace bars 35 connecting the transverse bar 34 to the top side bar sections 27' and 28', as best disclosed in FIG. 1.

The rear portions of the side panels 13 and 14 may have their netting 25 and 26 further reinforced by the corresponding rear frame bars 37 and 38, which are connected respectively to the rear bars 29 and 30 and the top bars 27 and 28.

The mounting frame 15 includes a substantially transverse rectangular frame 40 to which the wheels 16 are attached. Projecting upward from the rear corners of the frame 40 are upright standards 41 and 42, which may continue as extensions of the upright frame bars 29 and 30, if desired.

The reinforcing frame bars 37 and 38 also tend to maintain the side panel netting behind the rear of the bars 38 spaced a more nearly uniform width from each other to provide more space surrounding the basket 44 mounted on the backboard 45. The front portion of the rectangular frame 40 is secured to both upper and lower side frame bars 27 and 28 and 21 and 22 by the forward inclined struts 47 and 48, as best disclosed in FIG. 1. These struts 47 and 48, not only provide rigid connection between the mounting frame 15 and the chute 11, but also further reinforce the side panels 13 and 14.

The front panel 18 includes netting 49 whose sides are connected to the front upright frame bars 31 and 32, and also to a bottom front transverse bar 50.

In the space between the front bottom transverse bars 23 and 50 is a netted discharge panel 52 including a discharge opening 53 defined by a U-shaped frame member 54. The U-shaped frame member 54 is disclosed in FIG. 2 detached from the discharge panel 52 and forming the top portion of a ball receiver cradle 55. The cradle 55 further includes a pair of parallel elongated tubular ball support members 56. The tubular support members 56 are rigidly connected together by a rear transverse bar 57, which in turn is connected by a rear strut 58 to the rear or bight portion of the U-shaped frame member 54. The front portions of the frame member 54 are also secured to the front portions of the tubular support members 56 by a bow-shaped frame member 59.

Adjustably connected to the receiver cradle 55 is an elongated ramp member 60 having a pair of parallel longitudinally extending ball guide or ramp rods 61 which have the same transverse spacing as the tubular support members 56, such spacing being less than the diameter of a basketball 62 (FIG. 1). The front ends of the ramp rods 61 are connected to an upright front standard member 63 having an upward projecting transverse ball stop member 64.

As best illustrated in FIGS. 1 and 2, the ramp member 60 may be shifted or moved to various longitudinal positions relative to the cradle 55 by merely sliding the ramp rods 61 through their corresponding tubular guide members 56. Thus, if the basketball player or shooter desires to be shooting in a position closer to the basket 44, then he moves the ramp member 60 rearwardly toward the cradle 55 causing the ramp rods 61 to slide rearwardly within their corresponding tubular guide members 56. Conversely, when the player desires to shoot at a greater distance, he may grasp the stop member 64 and pull the ramp member 60 forward causing the ramp rods 61 to slide forward within their corresponding tubular guide members 56.

Figure 6:
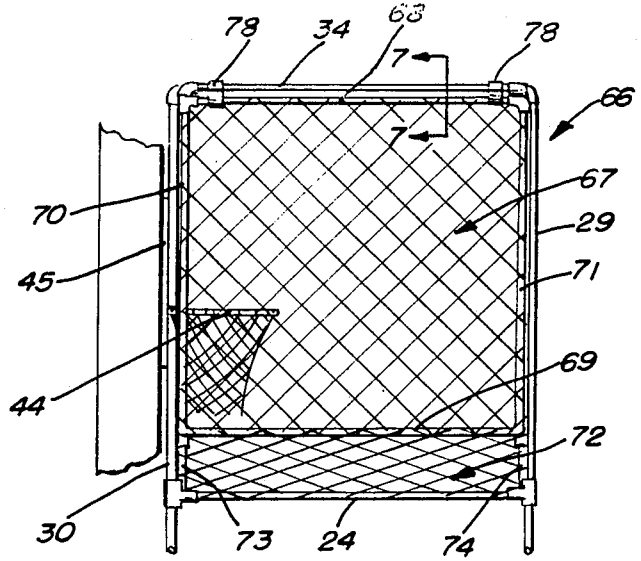
FIG. 6 is a fragmentary end elevational view taken along the line 6—6 of FIG. 5.
Figure 7:
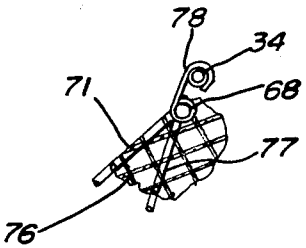
FIG. 7 is an enlarged fragmentary section taken along the line 7—7 of FIG. 6.
Figure 5:
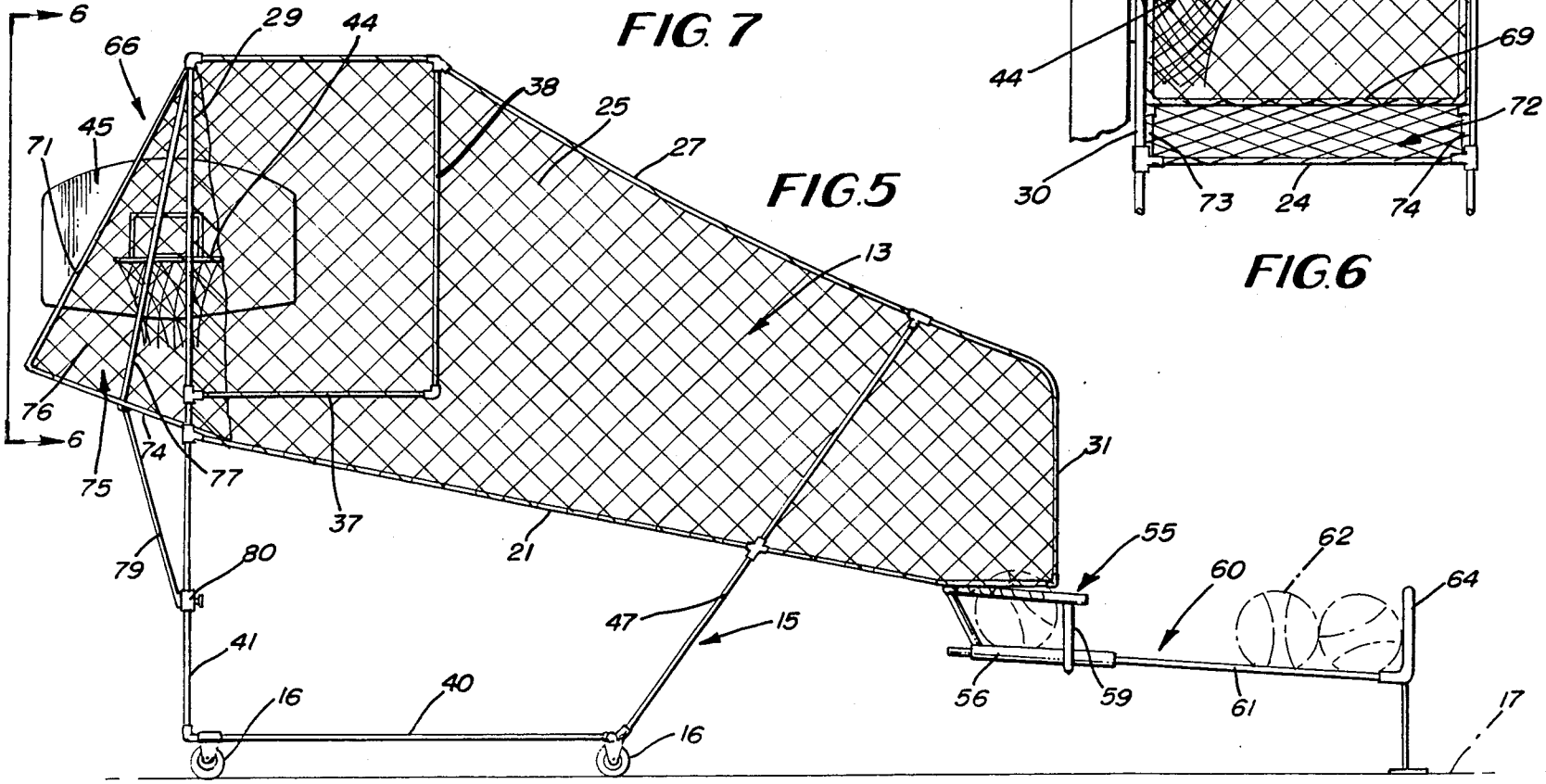
FIG. 5 is a side elevational view of the device disclosed in FIG. 1, positioned longitudinally parallel to the plane of the backboard, and further illustrating an auxiliary rear panel closure member.

FIGS. 5 and 6 disclose a rear closure assembly 66 adapted to enclose the open space behind the chute 11 when the chute 11 is positioned with its longitudinal axis parallel to the plane of the backboard 45, that is when the basketball player desires to attempt practice shots from the side of the basket 44.

The rear closure assembly 66 includes a rear closure panel 67 made of netting suspended between a top frame bar 68, a bottom transverse frame bar 69, and a pair of upright side frame bars 70 and 71.

Projecting forward from the bottom transverse frame bar 69 is a bottom closure panel 72 including netting which is suspended between the bottom frame bar 69 and a pair of forward projecting side frame bars 73 and 74. The bottom closure panel netting 72 has a free forward edge.

The rear closure assembly 66 further includes a left side panel 75 including netting 76 which is connected between the side frame bars 71 and 74 of the rear and bottom closure panels 67 and 72, and also to a diagonal side frame bar 77. As illustrated in FIG. 5, the loose netting 76 projects even farther forward from the side frame bar 77.

Fixed to project upward from the top transverse bar 68 of the rear closure panel are a pair of transversely spaced hooks 78 adapted to fit over the top transverse rear bar 34 of the chute 11.

Depending from the bottom transverse bars 73 and 74 are a pair of legs 79, which may be attached to the upright mounting frame bars 41 and 42 by clamps 80 of conventional construction. Thus, when the rear closure assembly 66 is assembled upon the open rear end of the chute 11, by hanging the hooks 78 upon the top transverse bar 34 and connecting the depending struts or legs 79 to the mounting frame 15, the free ends of the side frame bars 73 and 74 are inserted into the open rear end of the chute 11 and rest upon the bottom panel 12, so that all of the openings around the basket 34 are closed by the rear closure panel 67, the bottom closure panel 72, and the side closure panel 75. Not shown in the drawings is a right side closure panel, which is a mirror-image of the left side closure panel 75, on the opposite side of the rear closure assembly 66, which fits between the basket 44 and the backboard 45.

If it is desired to move the chute 11 through 180 deg. so that the basketball player may shoot from the opposite side of the basket 44, the same chute 11 and rear closure assembly 66 may be used by turning them 180 deg. to extend in the opposite direction from the basket 44.

Figure 8:
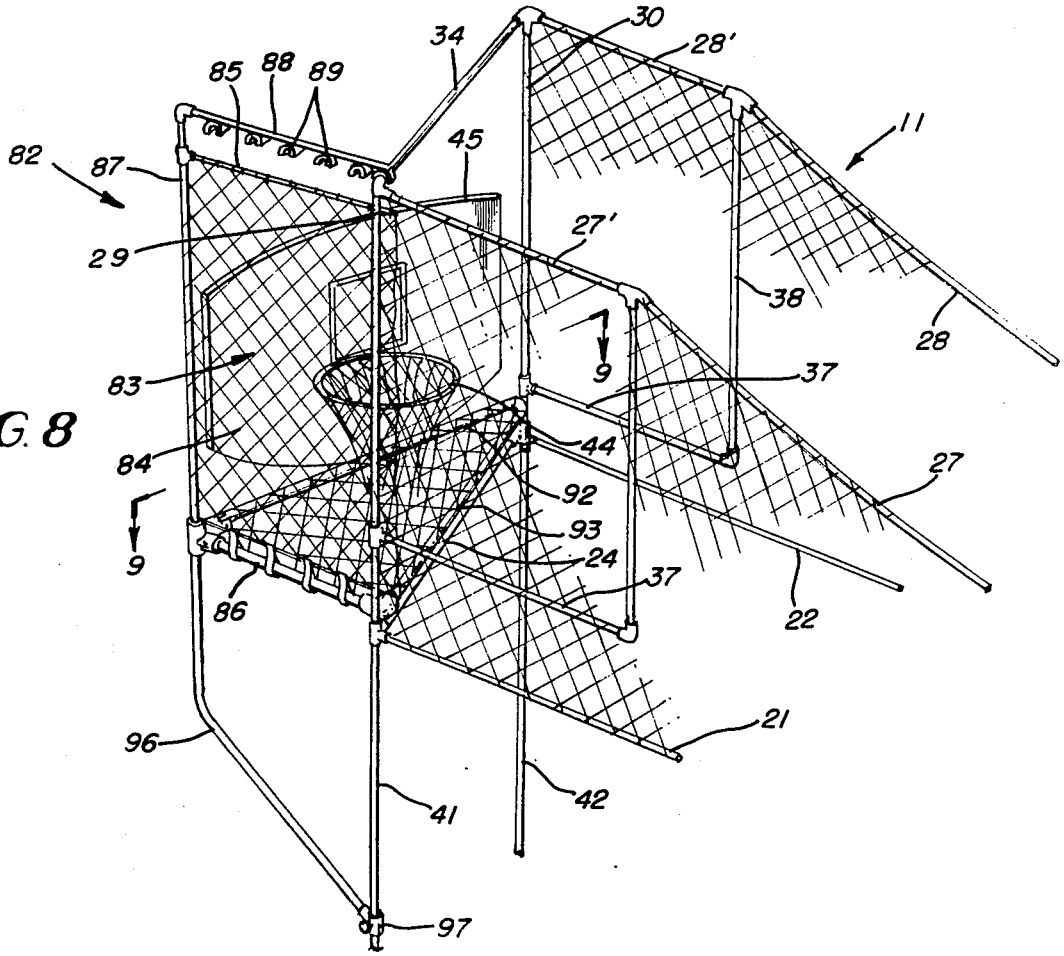
FIG. 8 is a top and side fragmentary perspective view of the device disposed at an angle of substantially 45 deg. to the plane of the backboard, and further illustrating a second modification of the rear closure panel member.
Figure 9:
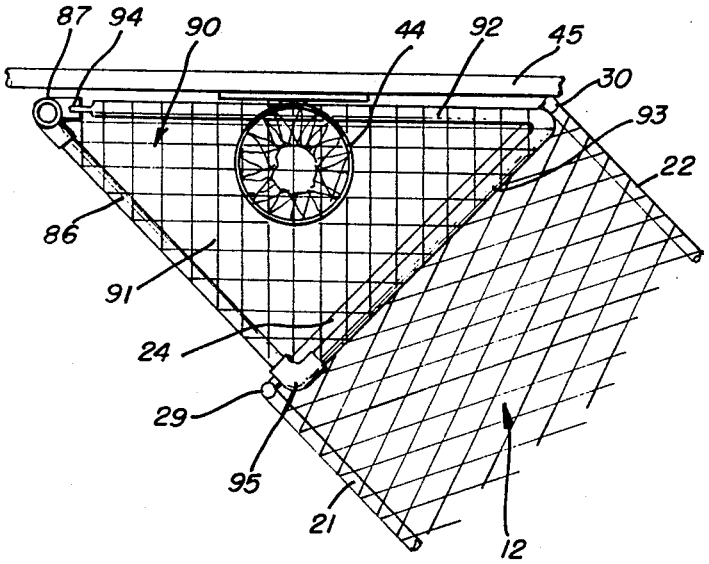
FIG. 9 is an enlarged fragmentary section taken along the line 9—9 of FIG. 8.
Figure 10:
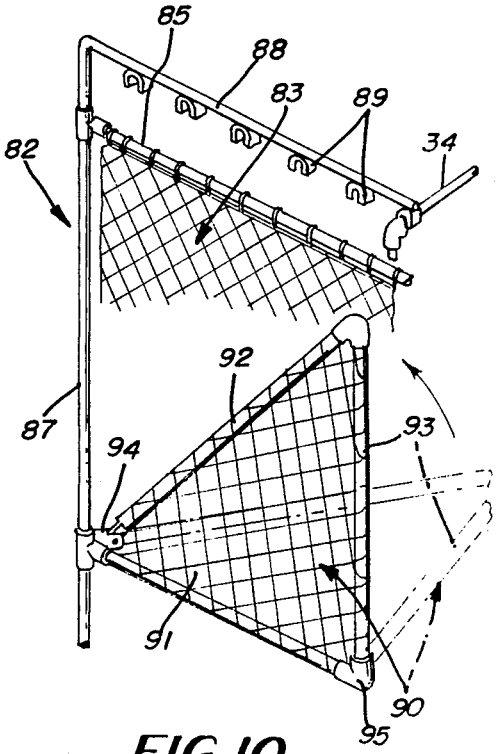
FIG. 10 is an enlarged fragmentary side perspective view of the auxiliary rear closure panel member, with the rear panel in its upright, inoperative, stowed solid-line position and in its lower operative phantom position.

FIGS. 8, 9 and 10 disclose a modified rear closure assembly 82 utilized when the chute 11 is disposed at an angle to the backboard 45, such as an angle of 45 deg. The rear closure assembly 82 includes a side panel 83 having netting 84 suspended between a top transverse bar 85, a bottom transverse bar 86 and a rear upright bar 87. The front edge of the netting 84 remains free.

The side bar 87 projects upward above the top transverse bar 85 to terminate in a forward projecting hook bar 88 supporting a plurality of longitudinally spaced transverse hooks or channels 89.

Hinged to the bottom of the side closure panel 83 is a bottom closure panel 90. The bottom closure panel 90 includes a bottom netting 91 suspended between the bottom transverse bar 86 and a pair of converging bottom bars 92 and 93. The end of the diagonal bar 92 proximate to the side panel 83 is pivotally connected to the side upright bar 87 by a hinge element 94, while the proximal end of the other bottom bar 93 is connected to the bottom transverse bar 86 by an elbow-type hinge element 95, so that the bottom closure panel 90 may swing between a bottom operative position disclosed in FIGS. 8 and 9 and in phantom in FIG. 10 and an upright, inoperative or stowed position disclosed in solid-lines in FIG. 10 against the side closure panel 83.

The upright side bar 87 continues below the bottom transverse bar 86 to form an angular forwarding projecting connector leg 96, the forward end of which may be secured to the upright mounting frame bar 41 by a clamp 97. A "VELCRO" attachment may be substituted for the clamp 97 to permit adjustment of the leg 96 along the upright bar 41 when the chute 11 is disposed at different angles to the backboard 44.

The purpose of the plurality of hook channels 89 is to permit the side panel to be hung upon the rear transverse bar 34 of the chute 11 for various angular positions of the chute 11 relative to the backboard 44.

Thus, when the chute 11 is disposed at an angle to the backboard 44, the rear closure assembly 82 is fitted within the open space between the rear end of the chute 11 and the backboard 44 for hanging the corresponding hook channel 89 over the transverse top bar 34 and connecting the bottom leg 96 to the upright bar 41, to close the side and bottom spaces behind the chute 11. The remaining spaces are closed by the backboard 44. The space above the basket 45 of course remains open to permit passage of the basketball toward the basket.

It is therefore apparent that a basketball retriever device 10 has been designed which is a substantial improvement over prior basketball retriever devices. The retriever device 10 is adapted to be shifted to various positions at angles to the backboard 44 to permit various shots to be taken toward the basket 45 from practically any position in a perimeter around the basket 45 through an arc of 180 deg.

Furthermore, the substantially vertical parallel closely spaced side panels 13 and 14 of the chute 11 functions as a sight guide for the shooter to improve the accuracy of the shooting of the basketball player.

Moreover, the extensible ramp member 60 telescopingly connected to the ball receiver cradle 55 permits the basketball player to take shots at various distances from the basket and still have the basketball 62 returned to a location adjacent to his shooting position to facilitate retrieving the returned basketball and repeating the shot.

The basketball retriever device 10 is made portable by the mounting frame 15 with its floor engaging wheels 16. Such portability not only permits the chute 11 to be positioned at various angles to the basket 45, but also facilitates removal of the device 10 from the basketball court 17 when it is not in use or for long-term storage.

What is claimed is:

1. A basketball retriever device adapted to be used on a basketball court in association with an elevated basketball basket and backboard, comprising:

(a) an elongated ball collector chute including an elongated bottom panel having a rear edge portion, a front portion and opposite side portions, and opposed upright side panels having rear edge portions and projecting upward from said side portions of said bottom panel, (b) a mounting frame fixed to said chute for supporting the rear edge portion of said bottom panel beneath a basketball basket on a basketball court in an operative shooting position, said bottom panel declining longitudinally forward, (c) said side panels projecting upward substantially above the basket and backboard when said chute is in said operative position, (d) said rear edge portions of said bottom and side panels defining a rear opening receiving the basket in said operative position, and said side panels terminating in spaced top edges defining a top opening, (e) a discharge opening in the front portion of said chute permitting the discharge of a basketball from said chute, (f) a basketball receiver cradle, (g) means supporting said cradle beneath said discharge opening for receiving a basketball passing through said discharge opening, and (h) an elongated ramp member adjustably positioned upon said cradle for receiving basketballs from said cradle.

2. The invention according to claim 1 in which said cradle has a front opening and an elongated sleeve member, said ramp member having an elongated slide member telescopingly received in said sleeve member whereby said ramp member may be longitudinally adjustably positioned relative to said cradle, said ramp member declining forward from said cradle for receiving basketballs on said ramp member by gravity from said cradle.

3. The invention according to claim 2 in which said ramp member comprises a pair of parallel elongated ramp rods being spaced apart less than the diameter of a basketball to be received on said ramp member, at least one of said ramp rods consisting of said elongated slide member.

4. The invention according to claim 3 in which both said ramp rods define said slide member, said sleeve member comprising a pair of elongated parallel tubular guide members telescopingly receiving said corresponding ramp rods, said guide members defining the bottom portion of said cradle for receiving a basketball in said cradle.

5. The invention according to claim 4 in which said cradle further comprises frame members fixed to said tubular guide members to enclose the side and rear portions of said cradle around a basketball received in said cradle and upon said guide members in an operative receiver position.

6. The invention according to claim 4 further comprising an upright front stop member on the front end portions of said ramp rods to limit the forward movement of a basketball on said ramp member.

7. The invention according to claim 6 further comprising a standard member depending from the front portion of said ramp member for supporting said ramp member on the floor of a basketball court in operative position.

8. The invention according to claim 1 further comprising an auxiliary closure panel adapted to close the space between said rear opening and the backboard, when said collector chute is in an operative position at an angle to the plane of the backboard, and attaching means for securing said auxiliary closure panel to the rear end portion of said collector chute.

9. The invention according to claim 8 in which said closure panel comprises a closure side panel and a closure bottom panel, a transverse rear rod connecting said top edges of the rear end portions of said side panels and defining the top edge of said rear opening, said attaching means comprising hanger means fixed to said side closure panel and adapted to hook over said transverse rear rod.

10. The invention according to claim 9 in which said bottom closure panel is pivotally connected to a hinge bar in the lower portion of said side panel to permit swinging movement of said bottom closure panel between an operative position forming an extension of the rear end portion of said bottom panel and an upright inoperative position against said closure side panel.

11. The invention according to claim 8 in which said closure panel comprises a rear closure panel, a side closure panel, and a bottom closure panel for assembly upon the rear end portion of said chute when said chute has its longitudinal axis substantially parallel to the plane of the backboard, in operative position.

12. The invention according to claim 11 further comprising a transverse rear bar connecting the top edge portions of the rear end of said side panels, said attaching means comprising hook members spaced transversely along the top edge portion of said rear closure panel, said hook members being adapted to engage said transverse rear bar.

* * * * *